United States Patent [19]

Berrebi

[11] 4,222,565

[45] Sep. 16, 1980

[54] LOGICAL DEDUCTION DEVELOPMENT GAME

[76] Inventor: Meyer Berrebi, 184, rue Marcadet, 75018 Paris, France

[21] Appl. No.: 964,583

[22] Filed: Nov. 29, 1978

[30] Foreign Application Priority Data

Dec. 12, 1977 [FR] France ..... 77 37390

[51] Int. Cl.[3] ..... A63F 9/06; G09B 19/00

[52] U.S. Cl. ..... 273/153 R; 35/21; 273/265

[58] Field of Search ..... 273/153 R, 156, 155, 273/284, 265; 35/30, 31 F, 21

[56] References Cited

U.S. PATENT DOCUMENTS

| | | | |
|---|---|---|---|
| 571,464 | 11/1896 | Truex | 273/258 |
| 715,794 | 12/1902 | Haskell | 273/284 |
| 2,732,211 | 1/1958 | Foster | 273/284 |
| 3,601,404 | 8/1971 | Weisbecker | 273/284 X |
| 3,981,503 | 9/1976 | Tsukuda | 273/287 |

*Primary Examiner*—Anton O. Oechsle

*Attorney, Agent, or Firm*—Fisher, Christen & Sabol

[57] ABSTRACT

The invention relates to an educational game intended for developing the logical deduction of the players, particularly of children, said game comprising on the one hand a model representing a plurality of ordered assemblies of squares to each of which is allocated a logic value 0 or 1, or a neutral value which may be equal to 0 or 1 according to the circumstances, all the ordered assemblies comprising the same number n of squares, and on the other hand a plurality of mobile elements such as pieces, counters, blocks, discs, etc., with at least one of the faces of each of which is associated the logic value 0 or logic value 1.

10 Claims, 12 Drawing Figures

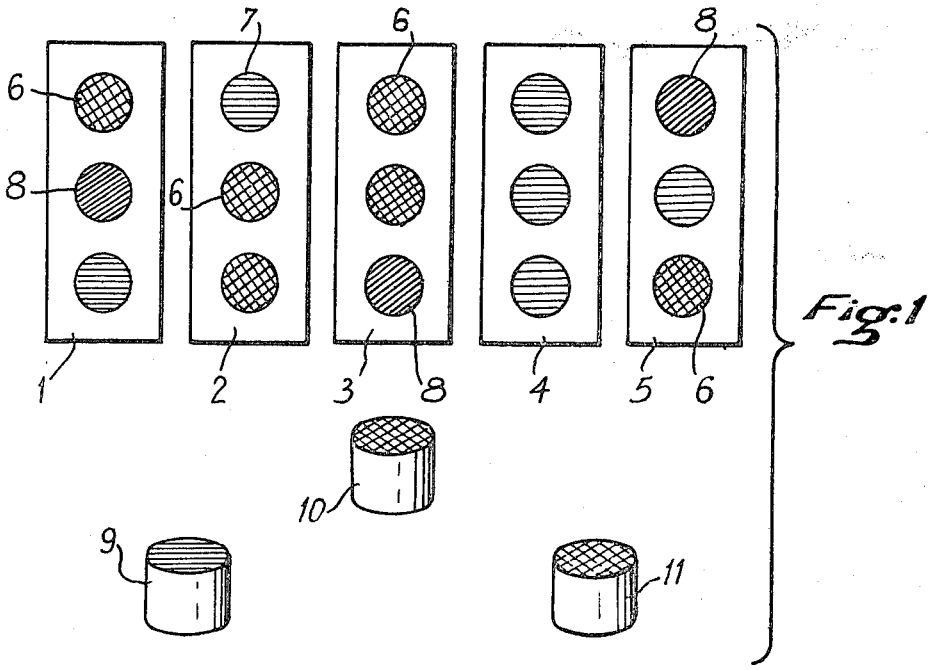
Fig:1
Fig:2
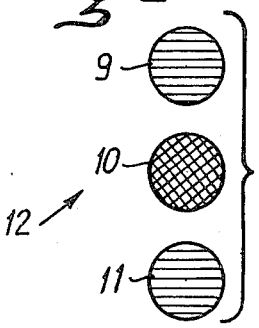
Fig:3
| | | | | |
|---|---|---|---|---|
| 1 | 0 | 1 | 0 | ∘ |
| ∘ | 1 | 1 | 0 | 0 |
| 0 | 1 | ∘ | 0 | 1 |
Fig:4
| | | | | |
|---|---|---|---|---|
| ∘ | 0 | ∘ | ∘ | 1 |
| 0 | 1 | ∘ | 0 | 1 |
| ∘ | ∘ | 0 | 1 | ∘ |
| 1 | 1 | 0 | 0 | ∘ |
Fig:5
| | | | | | | | | | | |
|---|---|---|---|---|---|---|---|---|---|---|
| 1 | 0 | 0 | 1 | 1 | 0 | ∘ | ∘ | ∘ | 1 | 0 |
| 0 | 1 | ∘ | 0 | 1 | ∘ | 1 | 0 | 0 | 1 | ∘ |
| ∘ | ∘ | 1 | 0 | ∘ | 1 | 0 | 1 | ∘ | ∘ | 0 |
| 1 | 0 | ∘ | ∘ | 0 | 1 | ∘ | ∘ | 0 | 1 | ∘ |
| ∘ | 0 | 1 | ∘ | ∘ | ∘ | 1 | 0 | 1 | ∘ | 0 |

| | | | | | | | | | | | |
|---|---|---|---|---|---|---|---|---|---|---|---|
| 0 | ∘ | 1 | ∘ | 1 | ∘ | 0 | ∘ | 0 | 1 | 0 | 1 |
| 0 | 1 | ∘ | ∘ | 0 | ∘ | ∘ | 1 | ∘ | ∘ | ∘ | ∘ |
| ∘ | 1 | 0 | ∘ | 1 | ∘ | ∘ | 0 | ∘ | ∘ | ∘ | ∘ |
| ∘ | ∘ | 0 | 1 | ∘ | 1 | 0 | ∘ | ∘ | ∘ | 1 | 0 |
| ∘ | 1 | ∘ | 0 | ∘ | 1 | 0 | ∘ | 1 | 0 | ∘ | ∘ |
| 0 | ∘ | ∘ | 1 | ∘ | 1 | ∘ | 0 | 1 | 0 | 0 | 1 |

| | | | | | | | | | | | | | |
|---|---|---|---|---|---|---|---|---|---|---|---|---|---|
| 1 | ∘ | 0 | ∘ | ∘ | ∘ | ∘ | 0 | 1 | ∘ | ∘ | 1 | 0 | ∘ |
| 1 | 0 | ∘ | ∘ | ∘ | ∘ | ∘ | ∘ | 0 | ∘ | 1 | ∘ | 1 | 0 |
| ∘ | 0 | 1 | ∘ | ∘ | 0 | 1 | ∘ | ∘ | 0 | ∘ | 1 | ∘ | ∘ |
| 1 | ∘ | ∘ | 0 | 1 | 0 | 0 | 1 | 1 | 0 | ∘ | 0 | ∘ | 1 |
| ∘ | 0 | ∘ | ∘ | 1 | ∘ | ∘ | ∘ | ∘ | 1 | 0 | ∘ | ∘ | ∘ |
| ∘ | ∘ | 1 | 0 | ∘ | 1 | 0 | ∘ | ∘ | ∘ | ∘ | ∘ | 0 | 1 |
| ∘ | ∘ | ∘ | 1 | 0 | ∘ | ∘ | 1 | ∘ | ∘ | 0 | ∘ | ∘ | ∘ |

LOGICAL DEDUCTION DEVELOPMENT GAME

The present invention relates to an educational game intended for developing the logical deduction of the players. It is particularly, but not exclusively, suitable for pedagogic purposes for giving the pupils and intellectual exercise capable of increasing their rapidity of logical understanding.

To this end, according to the invention, the game is characterised in that it comprises on the one hand a model representing a plurality of ordered assemblies of squares, to each of which is allocated a logic value 0 or 1 or a neutral value which may be equal to 0 or 1 according to the circumstances, all the ordered assemblies of squares comprising the same number n of squares and, on the other hand, a plurality of mobile elements such as pieces, counters, blocks, discs, etc. . . with at least one of the faces of each of which is associated a logic value 0 or the logic value 1, n of these mobile elements being able to be disposed to form an ordered assembly of the same nature as the ordered assemblies of said model, so that the values of the squares of the assembly formed by the mobile elements are in a determined logic relationship with the values of the squares of the assemblies of the models.

Each logic value 0 and 1, as well as the neutral value, are preferably respectively associated with specific colours. Thus, said model may be formed by an assembly of different coloured areas distributed in lines and in columns.

The terminated logic relationship existing between the squares of the model and the squares of the assembly formed by the mobile elements may be of any nature. For example, it may consist in that the ordered assemblies of squares of the model constitute "prohibited columns", the game consisting in constituting with the mobile elements an ordered assembly such that any ordered assembly thus constituted containing all the values indicated by any one of the "prohibited columns" and in the order indicated thereby is to be rejected. The matrix of squares constituting the representative model is preferably chosen so that, each time, there is one solution, and one only.

The model may be formed by a card and a game may be constituted by a plurality of different cards. As a variant, the model may be formed by the assembling of a plurality of independent squares, for example each constituted by a square-sectioned parallelepiped.

A cover may be provided, having as many identical perforated motifs as there are columns on the model, whilst said mobile elements are coloured portions of a motif identical to one of said perforated motifs, the number of said portions of this motive being equal to the number of lines of one column of the model.

In an advantageous embodiment, said model comprises a plurality of sets of different mixed ordered assemblies and a cover is provided which allows only one set at a time to appear. Such a model may be formed by a plurality of juxtaposed strips.

Each mobile element may comprise a face representing a logic 1 and a face representing a logic 0.

Similarly, certain independent squares may comprise two faces representing respectively a logic 1 and a logic 0, whilst other squares represent the neutral value.

The invention will be more readily understood on reading the following description with reference to the accompanying drawings, in which:

FIG. 1 illustrates a first embodiment of the game according to the invention.

FIG. 2 illustrates the exact answer to the problem raised by the game of FIG. 1.

FIGS. 3 to 7 give examples of matrices of the game according to the invention.

Figures 6, 7, 8:
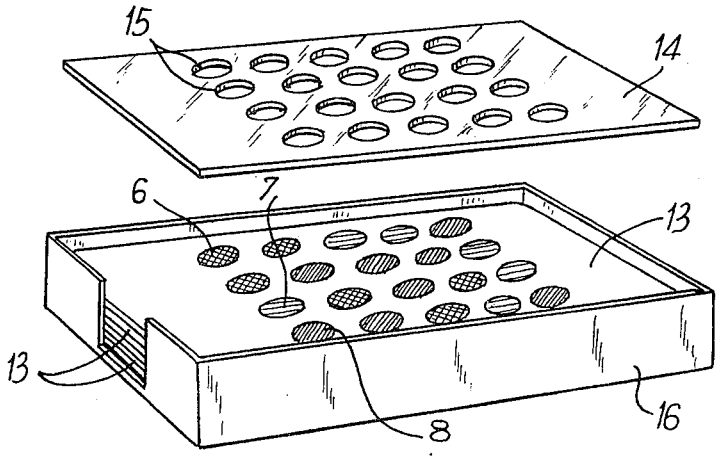

FIG. 8 shows a variant embodiment of the device according to the invention.

Figure 9:
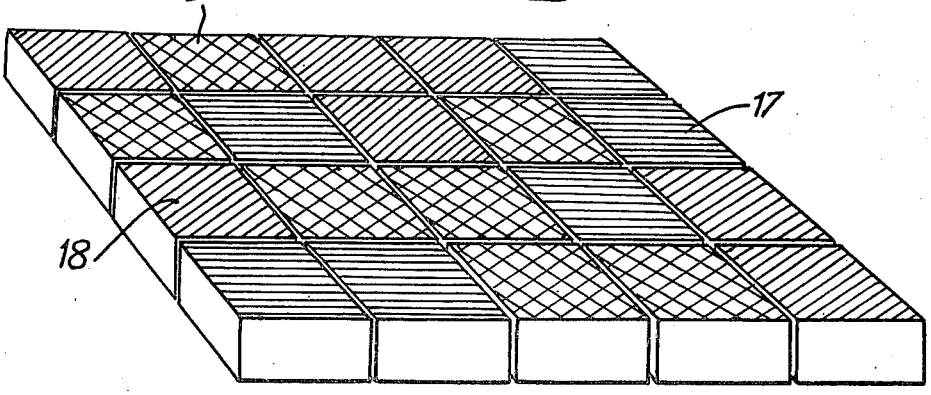

FIG. 9 shows another variant embodiment of the model of the game according to the invention.

Figure 10:
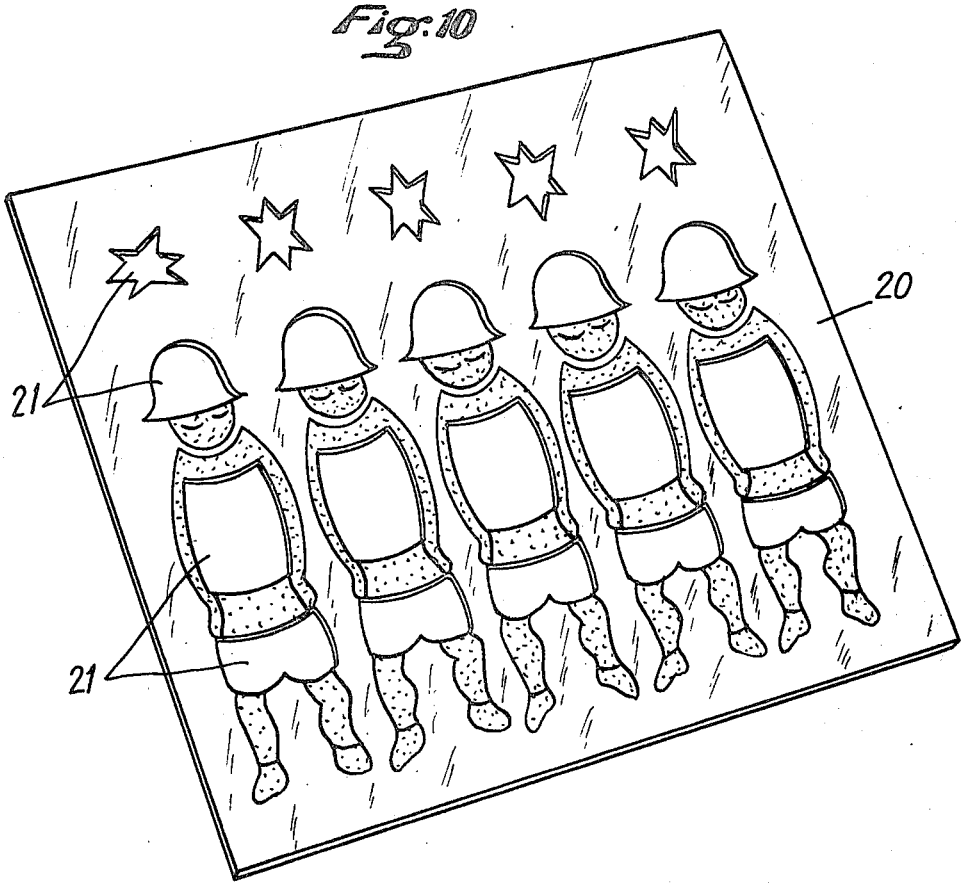
Figure 11:
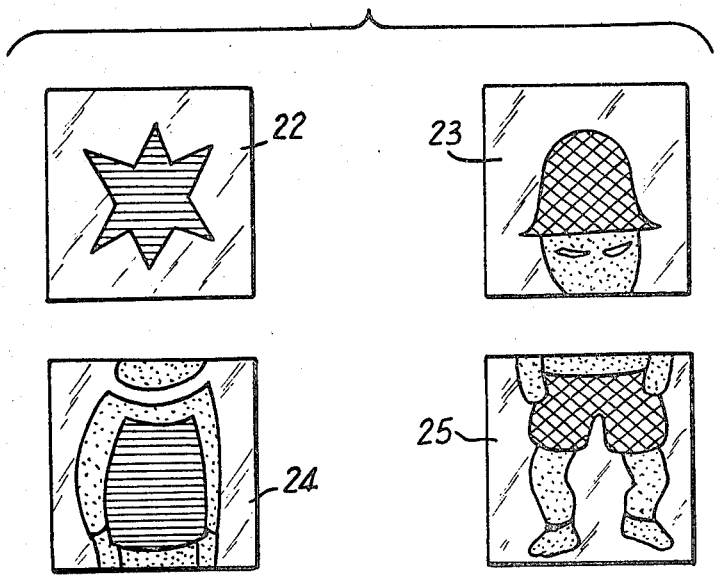

FIGS. 10 and 11 illustrate a new variant of the game according to the invention.

Figure 12:
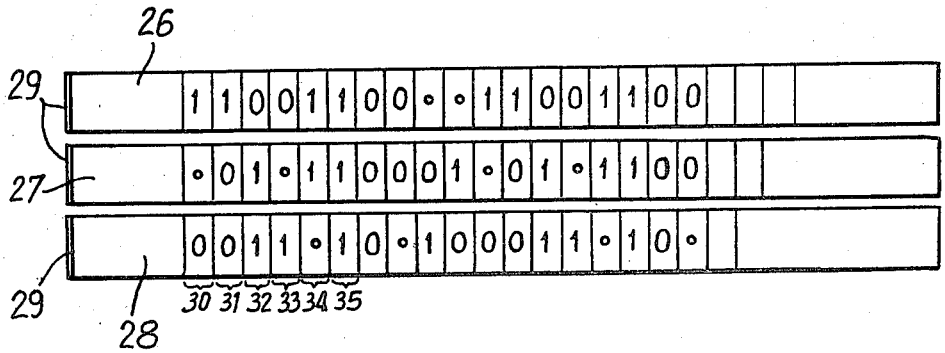

FIG. 12 illustrates a further variant of the model of the game according to the invention.

In these Figures, identical references denote like elements.

Referring now to the drawings, the game according to the invention, shown in FIG. 1, comprises on the one hand a model comprising five columns 1 to 5, each comprising three aligned squares, illustrated for example by discs 6,7 and 8 of different colours. The colour of the discs 6 represents for example a logic 1, that of discs 7 a logic 0, whilst the colour of the discs 8 may represent 0 or 1. The game also comprises pieces 9,10 and 11, for example cylindrical, of which the bases comprise areas coloured with the same colours as those of squares 6 and 7; for example, each piece 9, 10 and 11 is such that on one of its bases, it bears the colour of squares 6 whilst on its other base it bears the colour of squares 7.

If it is assumed that columns 1 to 5 each represent associations of 0 and 1 which must not be made and if the game consists, by observing said prohibited columns, in making with the pieces 9,10 and 11, a column 12, of the same nature as columns 1 to 5, but such that any column 12 containing all the coloured areas according to any one of columns 1 to 5 and in the order indicated by these columns, is to be rejected, then the solution is shown by FIG. 2. If the assembly of columns 1 to 5 is judiciously chosen, one solution 12 exists, and only one.

FIGS. 3 to 7 show a certain number of basic matrices intended to make it possible, with the hypotheses specified hereinabove, to obtain one solution and only one, respectively in the case of five prohibited columns each with three squares, five prohibited columns each with four squares, eleven prohibited columns each with five squares, twelve prohibited columns each having six squares and fourteen prohibited columns each having seven squares. In FIGS. 3 to 7, squares 6 have been represented by "1"s, squares 7 by "0" and neutral squares 8 by circles. Of course, these examples do not limit the invention. In particular, to obtain other, different games, it is possible, without changing direction, to permute the lines or columns of the matrix, and to replace as many lines as desired by lines of which the squares bear opposite values in two's. In this way, numerous possible games are obtained which always have one solution only.

As shown in FIG. 8, the columns of coloured areas of a game can be grouped on a card 13, possibly associated with a cover 14, provided with holes 15 through which areas 6,7 and 8 appear, when said screen covers the card 13. A game may comprise a plurality of different cards, for example stacked in a box 16, closed by cover 14.

In the device of FIG. 9, the matrix is formed by a plurality of juxtaposed parallelepipeds 17,18 and 19 of square section. Each parallelepiped, except for those representing a neutral value, may bear the colour representing a 1 on one large face and the colour representing a 0 on the other large face.

A cover of the type such as cover 14 of FIG. 8 may be associated with the matrix of FIG. 9. It may also be associated with a cover of the type such as 20 of FIG. 10, comprising a plurality of identical, juxtaposed perforated motifs, each of which is associated with a column of matrix 17, 18 and 19 on which it rests, the colours of the parallelepipeds of the matrix appearing through the outlines 21 of these motifs. In this case, the mobile elements at the disposal of the player or players comprise elements 22 to 25, possibly reversible, on which are reproduced coloured complementary parts of the motifs of the cover (cf. FIG. 11). By assembling the complementary parts of suitable colours, the single solution of the problem may be found.

FIG. 12 further illustrates another embodiment of a game according to the invention. This game comprises a plurality of juxtaposed strips 26, 27 and 28 bearing 0's (or corresponding areas) as well as neutral areas, and which, when their reference ends 29 are aligned, supply columns of squares. Each strip is such that the columns of squares belong alternately to two matrices of different games. For example, the columns 30, 32, 34, belong to the same game, whilst columns 31, 33, 35 belong to another game. To play with one or the other game, it suffices to cover the strips with a cover allowing only the squares of one column out of two to appear. Passage from one game to the other may be effected by simple translation of the cover by the width of a column.

The rear side of each strip may be the exact reproduction of the front side as far as the neutral squares are concerned, but the colour associated with the value 1 has changed into the colour associated with the value 0 and vice versa.

The matrices are such that the lines may be permuted or may be turned over, the ends 29 always having to be on the same side and aligned.

I claim:

1. Educational game for the development of logical deduction on the part of the players, especially children comprising:

a surface having a plurality of assemblies of n number of sequentially arranged areas;

each of said areas being provided with distinctive indicia to identify it with one of a first, second and third category;

the first category of areas being representative of logic 1;

the second category of areas being representative of logic 0;

the third category of areas being representative of a neutral value comprising both logic 1 and logic 0;

the sequence of the arrangement of categories of areas in each of said assemblies being different from the sequence of arrangement of the categories of areas in every other assembly of areas;

n number of mobile playing pieces to be arranged in sequential positions corresponding to the sequential positions of each of said areas;

each of said playing pieces being provided with indicia means representative of logic 1 and logic 0;

each of said playing pieces being also provided with means to display alternatively said logic 1 or logic 0 indicia when arranged in said sequential positions;

the sequence of the displayed indicia when said playing pieces are arranged in a predetermined sequence being dissimilar to the sequence of indicia displayed by each of said assemblies of areas.

2. A game as claimed in claim 1, wherein said indicia comprise specific colours.

3. A game as claimed in one of claims 1 or 2, wherein said surface is formed by an assembly of different areas distributed in lines and in columns.

4. A game as claimed in claim 3, wherein the surface is formed by a card and it comprises a plurality of different cards.

5. A game as claimed in claim 3, wherein said surface is formed by assembling a plurality of independent squares.

6. A game as claimed in claim 5, wherein certain independent squares comprise two faces respectively representing a logic 1 and a logic 0, whilst others are entirely representative of the neutral value.

7. A game as claimed in claim 1, comprising a cover provided with as many identical perforated motifs as there are columns on the surface and said mobile elements are coloured portions of a motif identical to one of said perforated motifs, the number of said portions being equal to the number of the lines of a column.

8. A game as claimed in claim 1, wherein said surface comprises a plurality of different mixed ordered assemblies and a cover is provided which allows only one assembly to appear at a time.

9. A game as claimed in claim 8, wherein the surface is formed by a plurality of juxtaposed strips.

10. A game as claimed in claim 1, wherein each mobile element comprises one face representing a logic 1 and one face representing a logic 0.

* * * * *